US009950853B2

(12) United States Patent
Irwin-Kieling et al.

(10) Patent No.: US 9,950,853 B2
(45) Date of Patent: Apr. 24, 2018

(54) COLLAPSIBLE INSULATED CONTAINER

(75) Inventors: Melissa Renee Irwin-Kieling, Westlake Village, CA (US); Jeannette Marie Brisacher-Dirksen, Westlake Village, CA (US)

(73) Assignee: PACKIT, LLC, Westlake Village, CA (US)

( * ) Notice: Subject to any disclaimer, the term of this patent is extended or adjusted under 35 U.S.C. 154(b) by 587 days.

(21) Appl. No.: 13/541,463

(22) Filed: Jul. 3, 2012

(65) Prior Publication Data

US 2012/0266628 A1 Oct. 25, 2012

Related U.S. Application Data

(63) Continuation of application No. 12/652,661, filed on Jan. 5, 2010, now Pat. No. 8,209,995.
(Continued)

(51) Int. Cl.
*B65D 81/38* (2006.01)
*A45C 3/00* (2006.01)
(Continued)

(52) U.S. Cl.
CPC ..... *B65D 81/3895* (2013.01); *A45C 3/001* (2013.01); *A45C 7/0077* (2013.01);
(Continued)

(58) Field of Classification Search
CPC ... A45C 3/001; B65D 31/10; F25D 2303/082; F25D 3/08
(Continued)

(56) References Cited

U.S. PATENT DOCUMENTS 536,103 A 3/1895 Snyder et al.
1,672,322 A 6/1928 Keiser et al.
(Continued)

FOREIGN PATENT DOCUMENTS

AU 2010238657 10/2014
CA 2758565 3/2016
(Continued)

OTHER PUBLICATIONS

Notification, International Search Report and Written Opinion dated Jan. 4, 2011 for PCT/US10/32249, 8 pages.
(Continued)

*Primary Examiner* — Elizabeth Martin
*Assistant Examiner* — Zachary R Anderegg
(74) *Attorney, Agent, or Firm* — Procopio Cory Hargreaves and Savitch LLP; Pattric J. Rawlins; Jonathan D. Cheng

(57) ABSTRACT

A collapsible insulated container has a base wall and a peripheral wall with an open end defining an enclosure. The peripheral wall has at least two layers and is divided into elongate pockets between the layers, with foldable crease lines between adjacent pockets. Each pocket contains a flexible-walled, insulating gel pack which substantially fills the pocket. The crease lines may be defined by stitching securing the outer and inner layers of the container together. The gel packs may be surrounded by matting, foam or mesh material which is sewn into the lines of stitching, or may have integral peripheral rims sewn into the lines of stitching. The container is foldable between an erect, open condition and a storage condition in which it is folded along the crease lines into a substantially flattened package.

8 Claims, 9 Drawing Sheets

Related U.S. Application Data

(60) Provisional application No. 61/214,364, filed on Apr. 23, 2009.

(51) Int. Cl.

| | |
|---|---|
| ***A45C 7/00*** | (2006.01) |
| ***A45C 11/20*** | (2006.01) |
| ***B65D 33/24*** | (2006.01) |
| ***F25D 3/08*** | (2006.01) |
| ***B65D 30/20*** | (2006.01) |

(52) U.S. Cl.
CPC ..... *A45C 11/20* (2013.01); *B65D 31/10* (2013.01); *B65D 33/24* (2013.01); *B65D 81/3897* (2013.01); *F25D 3/08* (2013.01); *B65D 2313/02* (2013.01); *F25D 2303/082* (2013.01); *F25D 2303/0832* (2013.01); *F25D 2303/0843* (2013.01); *F25D 2303/0845* (2013.01); *F25D 2323/061* (2013.01); *F25D 2331/801* (2013.01); *Y10S 220/907* (2013.01)

(58) Field of Classification Search
USPC ..... 62/457.2, 457.7
See application file for complete search history.

(56) References Cited

U.S. PATENT DOCUMENTS

| | | | | |
|---|---|---|---|---|
| 3,262,283 | A | 7/1966 | Taylor et al. | |
| 4,211,091 | A * | 7/1980 | Campbell | 62/372 |
| 4,679,242 | A | 7/1987 | Brockhaus | |
| 4,700,706 | A | 10/1987 | Munch | |
| 4,831,842 | A | 5/1989 | Kelley et al. | |
| 5,005,374 | A | 4/1991 | Spitler | |
| 5,274,865 | A | 1/1994 | Takehashi | |
| 5,490,396 | A | 2/1996 | Morris | |
| 5,533,361 | A | 7/1996 | Halpern | |
| 5,562,228 | A | 10/1996 | Ericson | |
| 5,857,778 | A | 1/1999 | Ells | |
| 5,904,230 | A | 5/1999 | Peterson | |
| 6,048,099 | A | 4/2000 | Muffett et al. | |
| 6,068,402 | A | 5/2000 | Freese et al. | |
| 6,220,473 | B1 | 4/2001 | Lehman | |
| 6,223,551 | B1 | 5/2001 | Mitchell | |
| 2,095,946 | A1 | 7/2002 | Greene | |
| 6,422,032 | B1 | 7/2002 | Greene | |
| 6,427,475 | B1 | 8/2002 | Defelice et al. | |
| 6,474,095 | B1 | 11/2002 | Chan | |
| 6,666,044 | B2 | 12/2003 | Gagnon | |
| 6,925,834 | B2 | 8/2005 | Fuchs | |
| 7,065,983 | B2 | 6/2006 | Trinh et al. | |
| 7,240,513 | B1 * | 7/2007 | Conforti | A45C 13/02 62/457.2 |
| 7,299,652 | B2 | 11/2007 | Gagnon | |
| 7,302,810 | B2 | 12/2007 | McCrory | |
| 7,344,022 | B2 * | 3/2008 | Madson | B65D 33/25 206/205 |
| 7,791,003 | B2 * | 9/2010 | Lockhart et al. | 219/387 |
| 7,874,177 | B2 * | 1/2011 | Azamy | 62/457.2 |
| 8,209,995 | B2 | 7/2012 | Kieling et al. | |
| 2001/0006083 | A1 | 7/2001 | Haberkorn | |
| 2002/0095946 | A1 | 7/2002 | Greene | |
| 2002/0189278 | A1 | 12/2002 | Defelice et al. | |
| 2003/0101743 | A1 | 6/2003 | Defelice et al. | |
| 2005/0056048 | A1 | 3/2005 | Fuchs | |
| 2005/0183446 | A1 * | 8/2005 | Fuchs | 62/457.7 |
| 2006/0198562 | A1 | 9/2006 | Mobil | |
| 2007/0044502 | A1 | 3/2007 | Hase | |
| 2007/0180850 | A1 | 8/2007 | Thompson | |
| 2008/0264925 | A1 | 10/2008 | Lockhart et al. | |

FOREIGN PATENT DOCUMENTS

| | | | |
|---|---|---|---|
| CN | 1390097 | A | 1/2003 |
| CN | 201207997 | Y | 3/2009 |
| DE | 29904488 | | 11/1999 |
| EP | 1035028 | A1 | 9/2000 |
| EP | 1291300 | A | 3/2002 |
| EP | 1384685 | | 1/2004 |
| EP | 2421772 | B1 | 6/2016 |
| EP | 3095729 | A1 | 11/2016 |
| JP | H1159739 | A | 3/1999 |
| JP | 2000203665 | A | 7/2000 |
| JP | 2002002828 | A | 1/2002 |
| JP | 2002205776 | | 7/2002 |
| JP | 2006027625 | A | 2/2006 |
| JP | 2006124013 | A | 5/2006 |
| JP | 2008230677 | A | 10/2008 |
| KR | 20-0397940 | | 10/2005 |
| KR | 200464545 | Y1 | 1/2013 |
| WO | WO1999032374 | | 7/1999 |
| WO | WO0122839 | | 4/2001 |
| WO | 2010124214 | A2 | 10/2010 |

OTHER PUBLICATIONS

Supplementary European Search Report for EP10767842.7 dated Oct. 9, 2012, 6 pages.
Notice of Acceptance dated Jun. 11, 2014, with Description as Accepted and Claims as Accepted for related Australian Patent No. 2010238657 in 20 pages.
Notice of Allowance dated Sep. 21, 2015, with allowed claims, for related Canadian Patent No. 2758565 in 7 pages.
Notice of Acceptance dated Oct. 28, 2016, with Description as Accepted and Claims as Accepted, for related Australian Patent Application No. 2014233619 in 25 pages.
Office Action (Provisional Refusal) for related Korean Patent Application No. 10-2011-7027993 dated Jul. 7, 2016, and corresponding English translation, in 15 pages.
Extended European Search Report for related European Patent Application No. 16173291.2 dated Sep. 30, 2016, in 7 pages.
EP Search Report application No. EP03254617 dated Nov. 6, 2003.
CN Search Report, application No. 202080011794.2 , dated Feb. 28, 2003.
Notification of the Third Office Action and Supplemental Search Report, dated Jun. 1, 2017 for related Chinese Patent Application No. 2014102230703, and partial English translation in 19 pages.
Communication pursuant to Article 94(3) EPC dated Dec. 8, 2017 for related European Patent Application No. 16173291.2, in 4 pages.
European Patent Office communication pursuant to Article 94(3) EPC, dated Dec. 8, 2017. 4 pages.

* cited by examiner

COLLAPSIBLE INSULATED CONTAINER

RELATED APPLICATION

The present application is a continuation of U.S. patent application Ser. No. 12/652,661 filed Jan. 5, 2010, now U.S. Pat. No. 8,209,995, which claims priority to U.S. provisional patent application No. 61/214,364 filed Apr. 23, 2009, each of which is incorporated herein by reference in its entirety.

BACKGROUND

Field of the Invention

The present invention relates generally to insulated containers for keeping food, drinks and other items cool or warm, and is specifically concerned with a collapsible insulated container.

Related Art

Self-supporting multi-purpose containers and coverings are used for packing, storing, transporting, and insulating food, beverages, and other items that need to be kept warm or cool for a significant storage period. The containers maintain a desired internal temperature for a period of time dependent on insulating capacity. Currently, cooler containers such as lunch boxes and bags, larger picnic coolers with rigid walls, and the like are merely insulated with foam, filled with ice, or alternatively a gel pack previously cooled in a freezer is placed into the container adjacent the item or items to be kept cool. Ice used in coolers melts and can make the items wet, making it unsuitable for use with certain types of food items. It is also bulky and takes up a significant amount of space in the cooler in order to provide adequate cooling. Loose gel packs used in such containers can often be lost, and also take up an amount of space which could otherwise be used for food and beverages.

Some known lunch bags on the market have an icy type of gel substance in the lining of the container walls. However, such containers are typically bulky and take up a relatively large amount of space in a freezer when cooling. Other containers are known which contain gel material in the walls for cooling or heating purposes, but these are also bulky and difficult to fold into a compact condition.

SUMMARY

Embodiments described herein provide for an insulated container with one or more pliable walls containing gel packs and designed to be foldable into a relatively flat, compact condition for storage and for placing in a freezer or microwave in order to chill or heat the gel prior to use of the container.

According to one embodiment, an insulated container has a base wall and a peripheral wall with an open end defining an enclosure for containing food, beverages or other items, the walls having at least an inner layer and an outer layer, at least part of the peripheral wall being divided into elongate pockets with foldable crease lines between adjacent pockets, each pocket containing an elongate, substantially flat gel pack which substantially fills the pocket. The gel pack has a flexible wall and contains an insulating gel. In one embodiment, the fold lines are defined by lines of stitching securing the outer and inner layers of the container together. The base wall may also have one or more pockets containing a gel pack.

In one embodiment, the container is generally rectangular in shape and the peripheral wall comprises a front wall, a rear wall, and opposite side walls. A closure flap extends from the open end and can be folded over the open end to close the container while it is in use. A fastener strap extends from the closure flap. In this embodiment, the front wall, rear wall, and base wall each contain gel packs, with the front and rear walls each containing at least two elongate gel packs extending parallel to the base wall with a foldable crease line of stitching or the like extending between adjacent pockets in each wall and across the respective wall between the side walls. The side walls contain no gel packs and have fold lines for enabling the container to be folded substantially flat with the front wall adjacent the rear wall. In order to fold the bag, the side walls are first folded inward and the front wall is positioned adjacent the rear wall. The base wall is then folded against the front wall, and the front and rear walls are folded over the base wall about the fold line between adjacent pockets. The closure flap and fastener strap are secured around the resultant compact folded package to hold it in the folded condition during storage. In one embodiment, selected fastener devices such as opposing strips of hook and loop fastener material are appropriately positioned on the outer surface of the bag and inner surface of the strap to assist in holding the bag in the folded storage position.

This bag is not only easy to fold into a compact storage position which it maintains during cooling or heating, it is also easy to return the bag to an upright open position ready for use. All that is necessary is to release the closure strap and then shake the bag open.

The bag may be of appropriate shape and dimensions for use as a lunch bag, or for a grocery shopping bag or larger size cooler container. For larger size containers, vertically spaced rows of two or more aligned pockets each containing a gel pack are arranged in the front and rear walls, with first crease lines separating the adjacent rows of pockets and second crease lines transverse to the first crease lines separating the adjacent pockets in each row. For a simple lunch bag, adjacent rows may each comprise a single elongate pocket containing a single elongate gel pack. In such cases, the gel packs are oriented substantially horizontally when the bag or container is in an upright, open condition. In an alternative embodiment, the peripheral wall may be of round or other non-rectangular cross section. For example, a wine or soda can cooler may have a generally cylindrical peripheral wall with elongate gel packs arranged in pockets extending between the base and open end of the container and separated by generally vertical fold lines or lines of stitching about which the container is folded into a generally flat, compact condition. One or more straps may be provided on the outside of the container for securing it in the folded condition.

The insulated container may be produced in a variety of shapes and sizes and has numerous applications including lunch sacks, cylindrical shapes for water bottles, baby bottles, sports drinks, wine bottles, and the like, shopping bags or totes, larger size cooler containers for barbeques, picnics, parties and the like, as well as large commercial delivery bags and totes. The location of the fold or crease lines allows the containers to collapse into a compact form.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
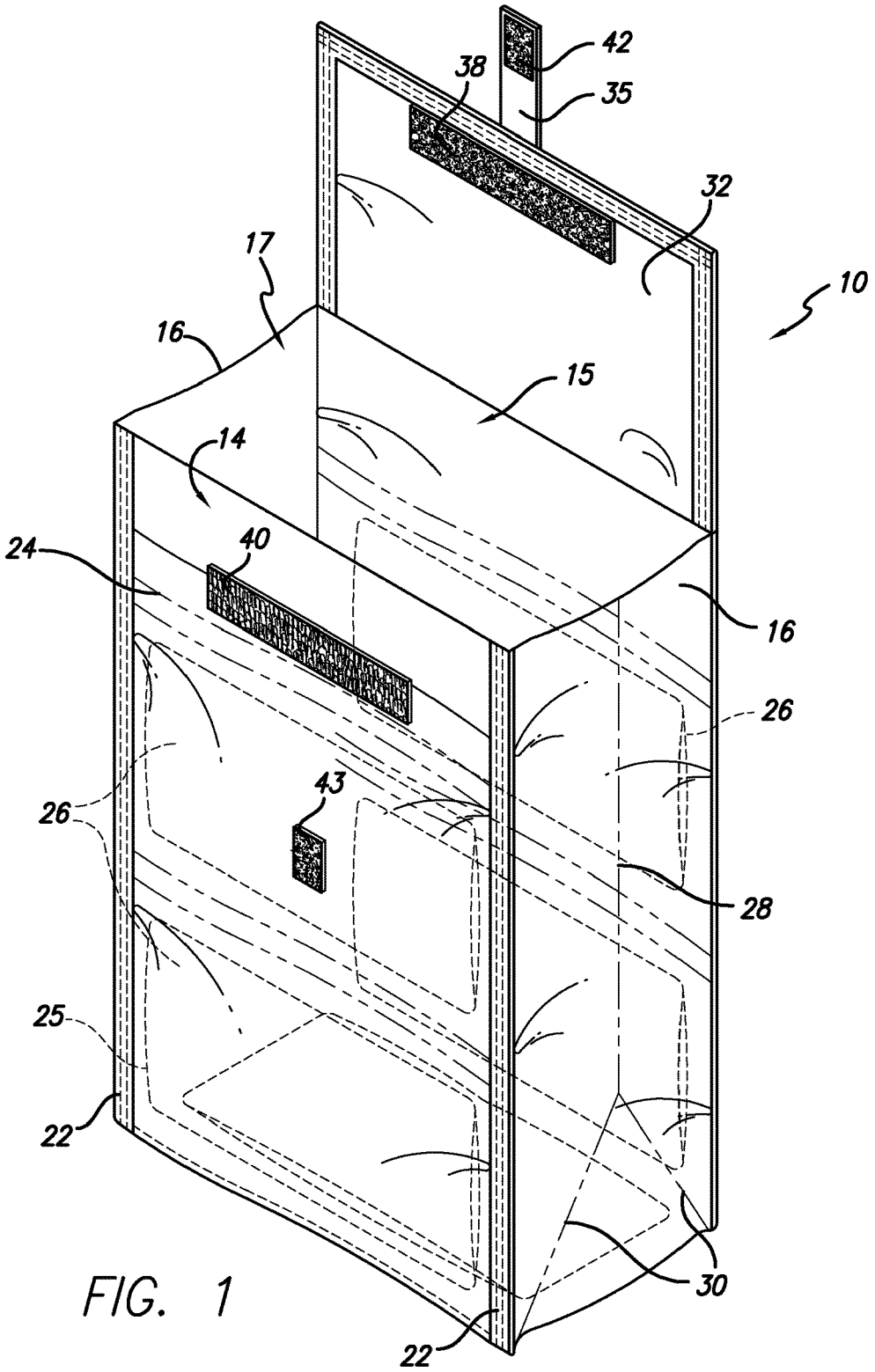
FIG. 1 is a front perspective view of one embodiment of a collapsible insulating container in an erect, open condition.

Certain embodiments as disclosed herein provide for an insulated container for food, beverages and other items which is adapted to be collapsed into a compact package for storage, heating, and cooling purposes when not in use. After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

FIGS. 1 to 6 illustrate a first embodiment of a collapsible insulated container 10, which comprises a generally rectangular, sack-like enclosure having a base wall 12, front and rear walls 14, 15, and opposite side walls 16 defining a cavity with an open end 17 which receives items to be transported or stored in the container, such as foods, beverages, and the like. In one embodiment, container 10 is designed as an insulated lunch sack. As illustrated in FIG. 2, the container walls are in four layers, with an outer wall 18 of protective, relatively strong synthetic or natural fabric material such as canvas, nylon, coated polyester or the like and an inner wall 20 of a foil-like, waterproof material such as a plastic foil material, or polyvinyl acetate, and outer and inner middle layers 21, 23 of insulating foam material such as a high density polyethylene (HDPE) foam. The layers of adjacent wall panels are sewn together with side seams or lines of stitching 22 at the intersections of the side walls 16 with the front wall 14, base wall 12, and rear wall 15, with the front wall, base wall and rear wall comprising a single continuous length of multiple layered wall panel material. In addition to the lines of stitching between the side walls and adjacent walls, transverse foldable crease lines 24 extend between stitching lines 22 at spaced intervals on the front and rear walls and also at locations defining the junction between the front wall and base wall and between the rear wall and base wall.

The foldable crease lines 24 in the illustrated embodiment are formed by lines of stitching extending through the four layers 18, 21, 23, 20, as best illustrated in FIG. 2, and pockets 25 are formed in the front, base and rear walls between adjacent crease or stitching lines 24 and between the opposite stitching lines 22 at the outer sides of the walls. Each foldable crease line 24 may be formed by a single line of stitching or by two or more spaced, parallel lines of stitching, for example two lines of stitching 24 as illustrated in FIG. 1. By providing two or more spaced lines of stitching, a wider crease or bend region is provided between adjacent gel pack pockets, so that the container can be folded into a more flat condition. An elongate gel pack 26 is located in each pocket between the outer and inner foam layers 21 and 23. In the illustrated embodiment, two gel packs 26 are located in separate upper and lower pockets in both the front wall and rear wall, and one gel pack is located in the base wall, although different numbers of gel packs may be incorporated into the walls in alternative embodiments, depending on the sizes of the gel packs and the container. No gel packs are located in the side walls in the illustrated embodiment. Each gel pack comprises an outer wrapper or envelope of flexible or pliable material such as plastic film which is filled with an insulating, non-toxic gel material, which may be any such material known to those of skill in the art, such as silica gel. The amount of fill is such that the gel pack is substantially flattened in shape. Such gel packs may be cooled in a freezer or heated in a microwave or the like, and maintain their temperature over extended periods of time.

Figure 2A:
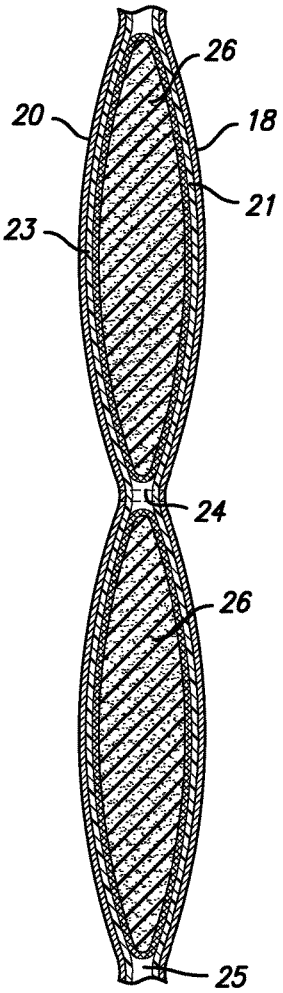
FIG. 2A is a vertical cross-sectional view through part of the front wall of the container of FIG. 1, illustrating two pockets each containing an insulating gel pack.
Figure 2B:
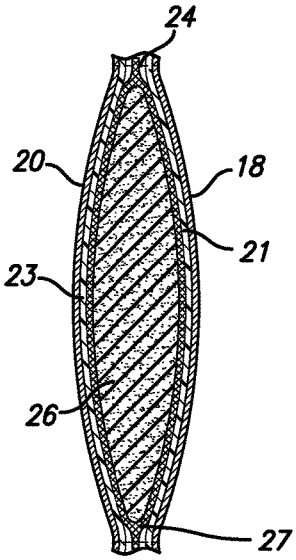
FIG. 2B is a vertical cross-sectional view similar to FIG. 2A but illustrating an alternative arrangement for securing a gel pack in position in a pocket.
Figure 2C:
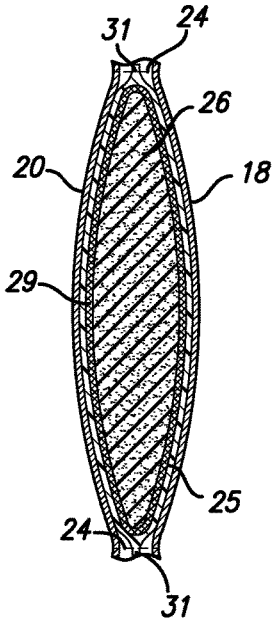
FIG. 2C is a vertical cross-sectional view similar to FIG. 2B illustrating an alternative embodiment.

In the embodiment illustrated in FIG. 2A, individual gel packs 26 are held in the respective pockets between the two insulating foam layers 21 and 23 and substantially fill the pocket to avoid or reduce pooling of fluid in the gel packs at one end of the pack. FIG. 2B illustrates an alternative embodiment in which the outer envelope of each gel pack has an integral peripheral rim or shoulder 27 extending around all or part of its periphery, and the rim 27 is sewn into the lines of stitching 24 between adjacent pockets. Rim or shoulder 27 may also be sewn into the seams 22 at opposite ends of the pocket when it extends around the entire perimeter of the gel pack. This holds the gel pack in an extended position in the pocket and prevents slumping of the gel pack to a lower end of the pocket when the container is in the upright position of FIG. 1 or when the container is folded, so that the gel pack can be maintained in a substantially flattened, compact condition. FIG. 2C illustrates another alternative arrangement in which each gel pack is individually wrapped with a matting material 29, and outer areas 31 of the wrapping are sewn into the stitching lines 22 and 24 surrounding the pocket so as to hold the fluid gel material in the gel pack more tightly and uniformly across the area of the gel pack, so that it remains in a more flattened condition. The matting material 29 may be a woven mesh material, an elasticated material, or an insulating foam material. The inner layers 21, 23 of foam material may be omitted in this embodiment, or may be included to provide additional cushioning.

Each side wall of the container 10 has a first foldable crease line 28 extending from the center of its upper end towards the lower end or base wall, and a pair of crease lines 30 in an inverted V-shape extending from the lower corners of the side wall with the apex intersecting the lower end of crease line 28. Each crease line 28, 30 is a single line of stitching. This arrangement allows each side wall to be folded inwardly so that the front and rear wall can be collapsed face to face prior to folding, as explained in more detail below in connection with FIGS. 5 and 6.

The container has a closure flap 32 comprising an upward extension of rear wall 15 which contains no gel packs. A handle strap 34 is secured on the outer surface of the closure flap 32 so as to extend upward for carrying purposes when the flap 32 is in a closed condition. An elongate fastener strap 35 extends transversely from the free edge 36 of the closure flap 32, as seen in FIG. 1. Closure flap 32 is held in a closed position over the open end of the bag via any suitable mating fastener devices, such as mating strips 38, 40 of hook and loop fastener material, e.g. Velcro®, secured on the outside of the front wall of the bag at a predetermined spacing from the open upper end and on the inner surface of the flap 32 adjacent the free edge 36, as seen in FIG. 1. The strips are positioned so that they are in alignment when the flap is closed. In one embodiment, strip 38 is of hook material while strip 40 is of loop material, but this may be reversed in other embodiments.

Figure 3:
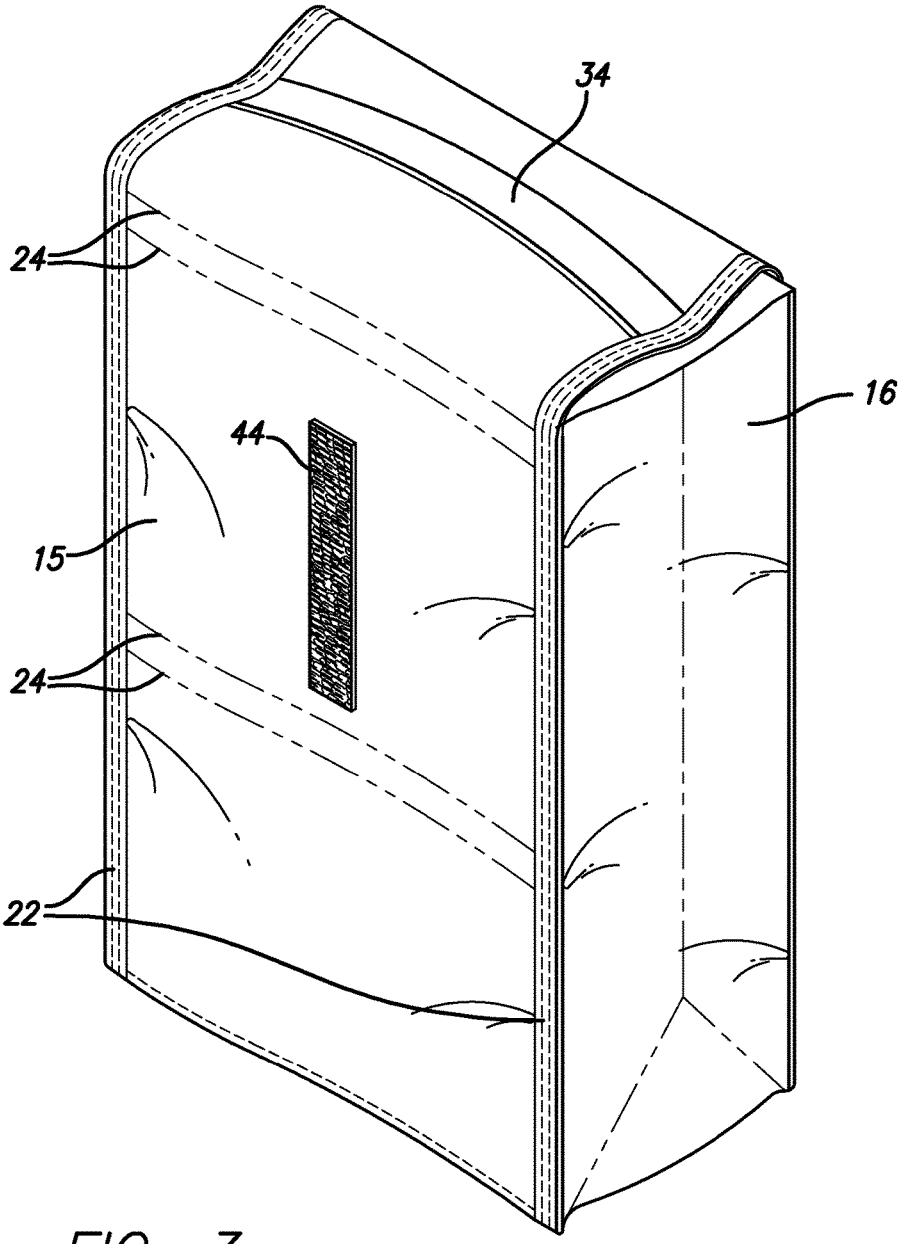
FIG. 3 is a rear perspective view of the container of FIG. 1 with the closure flap closed over the open end of the container.
Figure 4:
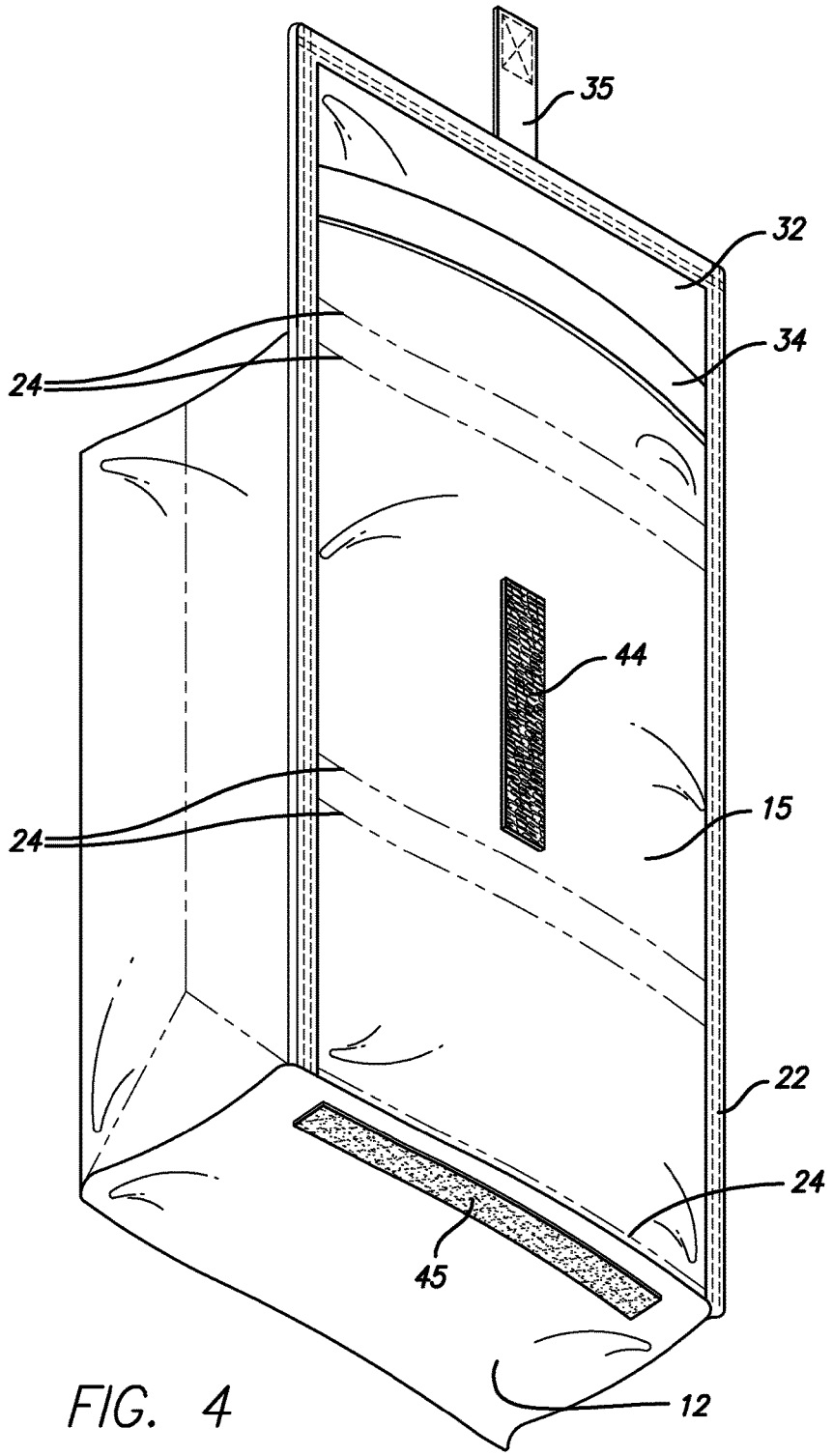
FIG. 4 is a perspective view of the container of FIGS. 1 to 3 from a different direction.

Fastener strap 35 also has a fastener device comprising a strip 42 of fastener material secured on its inner surface and extending to its free end, as seen in FIG. 1. A mating fastener device or strip 43 of fastener material may be provided on the front wall beneath strip 40, for engagement with strip 42 on the fastener strap 35 when the closure flap is closed, as in FIG. 3, and the container or lunch sack 10 is in use. Strip 43 is optional and may be omitted in alternative embodiments. A second mating fastener device or strip 44 of fastener material is secured on the rear wall of the container, as illustrated in FIG. 3. In one embodiment, strip 42 is of hook type fastener material while strip 44 (and strip 34 if present) is of loop type fastener material, although this may be reversed in alternative embodiments. Other types of fastener devices may be provided in place of fastener strips 42, 44 in alternative embodiments, such as a hook and eye, button and eyelet, snap fasteners, and the like. Fastener strips 42, 44 extend in a direction transverse to strips 38 and 40. In one embodiment, an additional strip 45 of fastener material may be provided on the base wall, as seen in FIG. 4, extending parallel to strips 38 and 40. Strip 45 may be designed to adhere to strip 40 when the bag is folded, and is of the same type of fastener material as strip 38 in this case. Alternatively, strip 45 may be omitted or may be designed to fasten to an additional strip at an appropriate position on the front wall.

Figure 5:
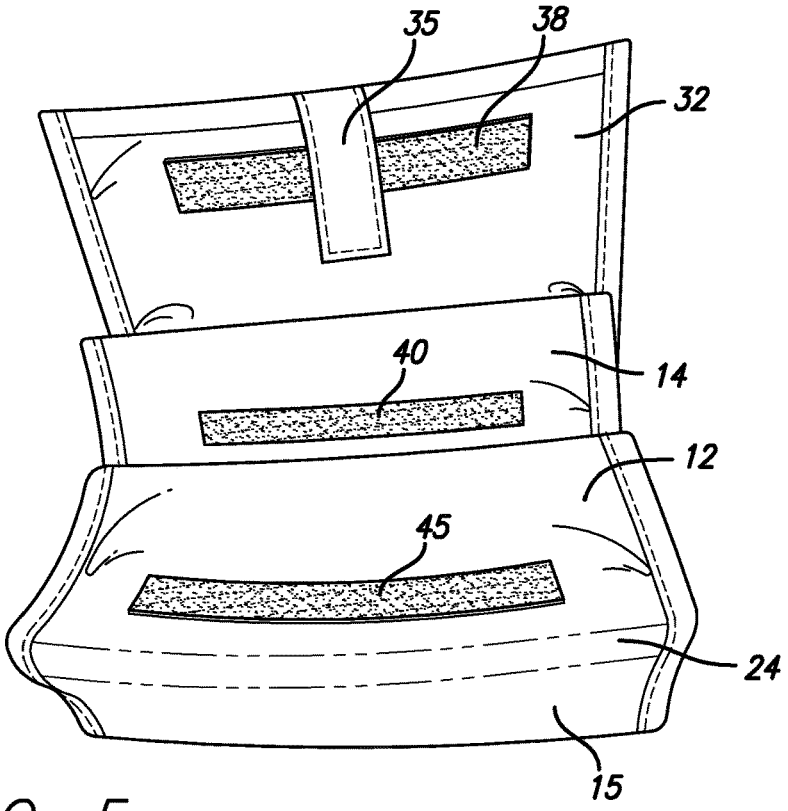
FIG. 5 is a front perspective view of the container of FIGS. 1 to 4 in a partially folded condition.
Figure 6:
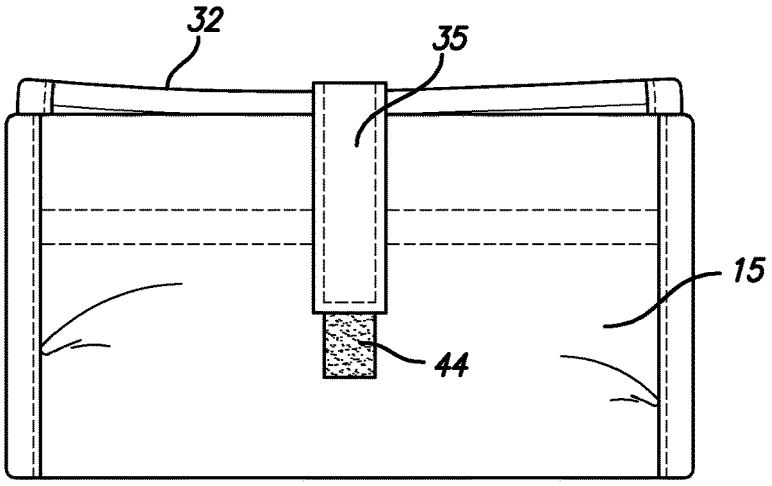
FIG. 6 is a rear elevation view of the container of FIGS. 1 to 4 in a fully folded, storage condition.

The container 10 of FIGS. 1 to 4 can be folded into a relatively compact, partially or completely flattened condition for storage, freezing or heating purposes when not in use, as illustrated in FIGS. 5 and 6. In order to fold the bag, the side walls are folded inwardly about the crease lines 28 and 30 so that the front and rear walls can be positioned adjacent one another. The base wall is folded down about foldable crease lines or regions 24 at the lower end of the front and rear walls so that it lies substantially flat against a lower part of the rear wall and superimposed portions of the front and rear walls, as illustrated in FIG. 5. The remainder of the bag or container above the folded base wall is then folded down over the base wall 12 with the flap 32 extending over part of the rear wall so that the Velcro® strip 42 on fastener strap 35 can engage the mating strip 44 on the rear wall, as in FIG. 6. FIG. 6 illustrates the container in a compact, at least partially flattened storage condition with the fastener strap 35 securing the container in this condition.

When the container is folded into the flattened storage condition, it can easily be placed into a freezer for cooling purposes or into a microwave to be heated, depending on whether food or other items to be carried in the container or lunch sack need to be kept warm or cool. Subsequently, the folded container is removed from the freezer or microwave, and can be quickly and easily returned to an erect, open configuration simply by releasing fastener strap 25 from the mating Velcro® strip 44 of fastener material, then shaking out the sack to open it. Food items, beverages, or the like can then be placed into the bag or sack, the closure flap 32 is closed and secured to Velcro® strip 40, and the sack can be carried via handle 34 for transportation purposes, for example to a workplace, school, or the like. Thus, items in the container are both cushioned from damage and insulated by the gel packs which maintain the container contents under desired temperature conditions for extended periods of time.

Figure 7:
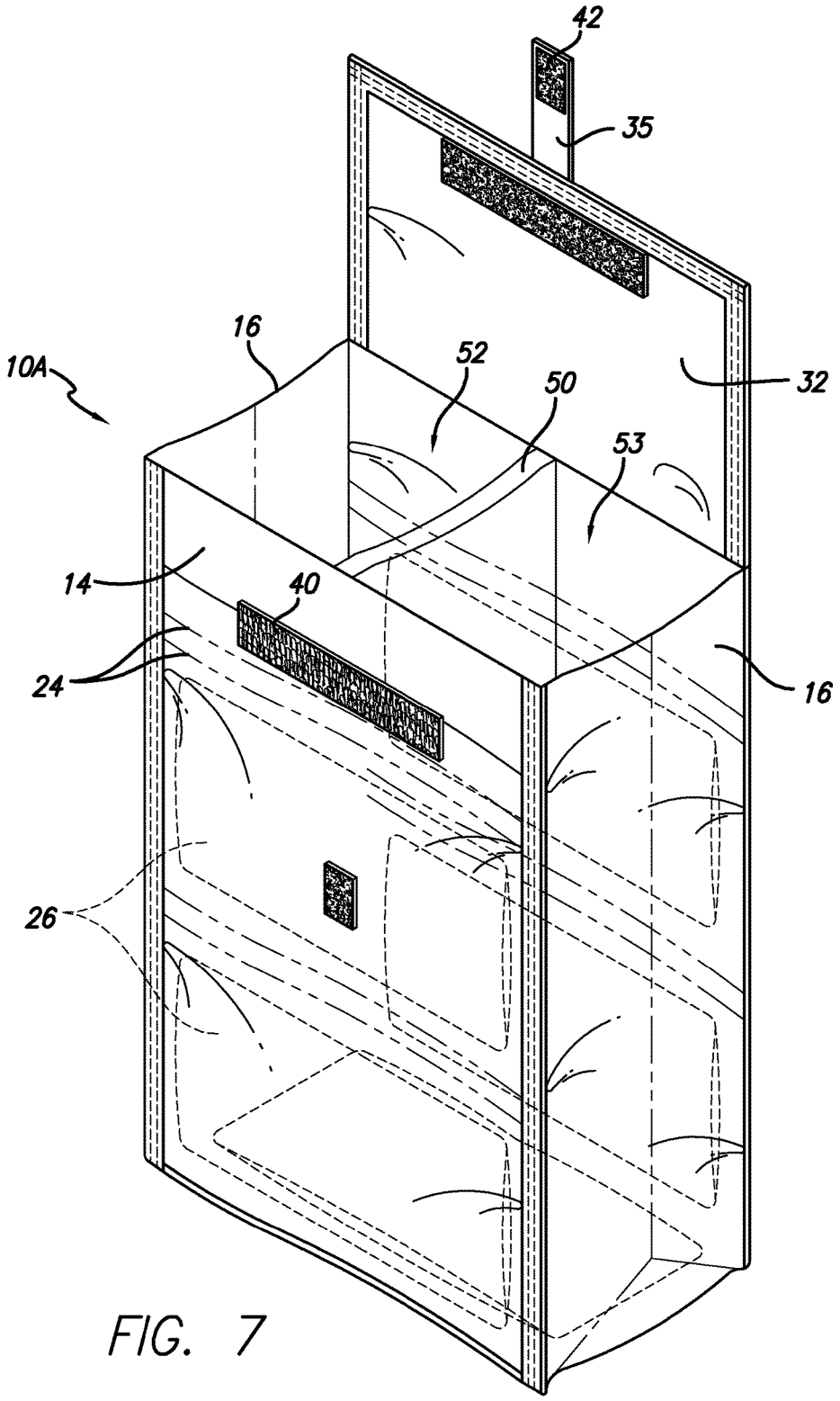
FIG. 7 is a perspective view of the container of FIG. 1 in an open condition, illustrating an optional dividing wall.

In the modification illustrated in FIG. 7, a collapsible insulated container or lunch sack 10A is provided with an insulated divider wall 50 which separates the internal cavity or food holding space 17 into two separate storage areas 52, 54. The divider wall is sufficiently pliable to allow the container 10A to be collapsed into the folded configuration of FIG. 6, and may be removable from the container if it is not needed. Other parts of container 10A are identical to those of the first embodiment, and like reference numbers have been used for like parts as appropriate.

The container in the embodiments of FIGS. 1 to 6 and 7 may have dimensions similar to those of a typical lunch sack. In one example, the dimensions of the base wall were around eight inches by four inches, the height of the front wall was around 13.5 inches, and the height of the closure flap 32 was around six to eight inches. The gel packs may be commercially available gel packs having dimensions of the order of 4.5 inches in width, 6.5 inches in length, and 0.25 inches in thickness. In one embodiment, the gel packs are Ecogel™ ice refrigerant packs made by Pelton Shepherd Industries of Stockton, Calif.

Figure 8:
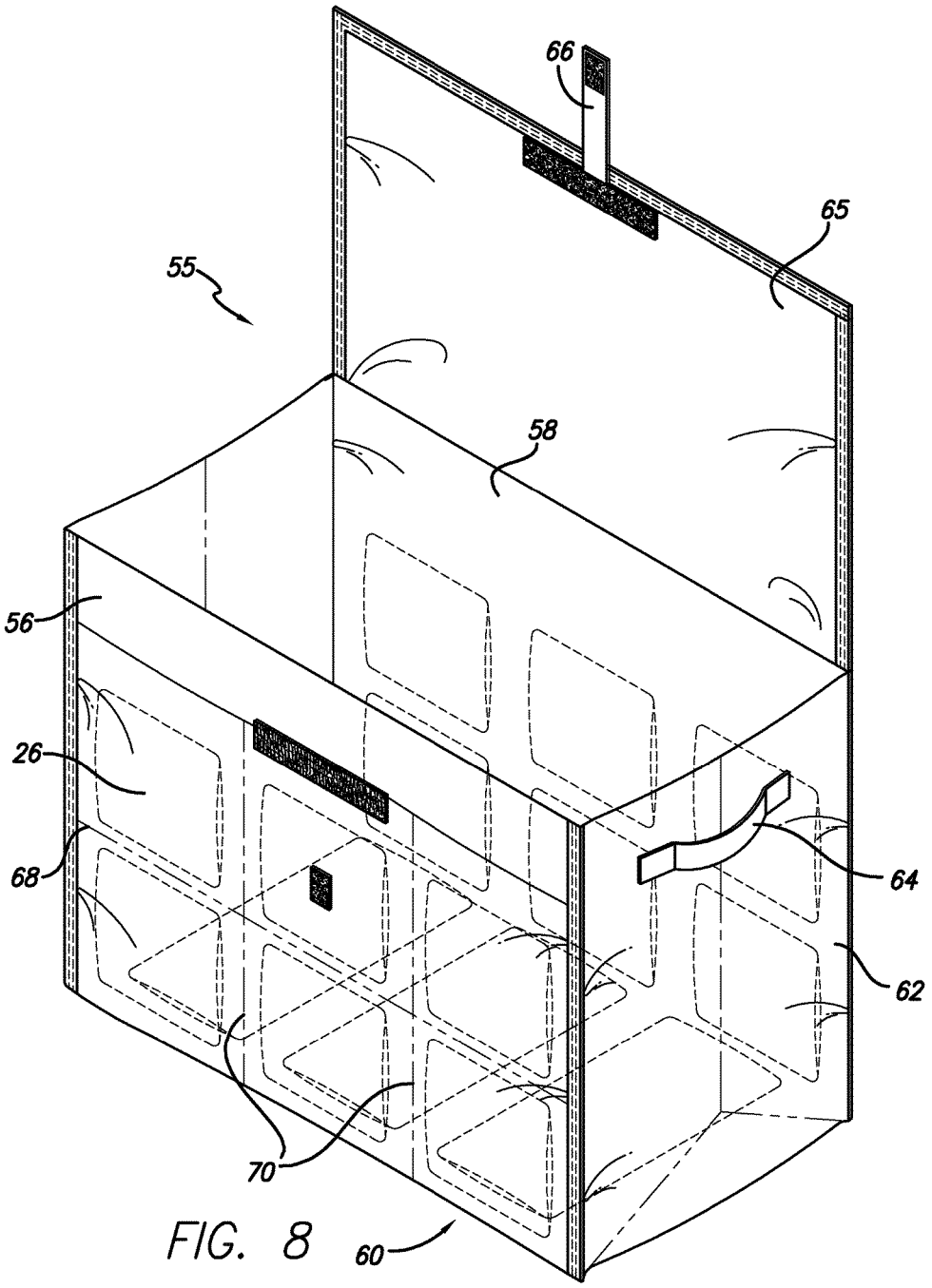
FIG. 8 is perspective view of a second embodiment of a collapsible insulating container in an open, erect condition.

FIG. 8 illustrates another embodiment of a collapsible, insulated container 55 which is of larger dimensions than lunch bag or sack 10 and is suitable for use in place of a standard, rigid wall cooler box. As in the previous embodiments, the container 55 is generally rectangular and has a front wall 56, rear wall 58, base wall 60, and opposite side walls 62. A handle 64 is located on each side wall. A closure flap 65 extends from the upper edge of the rear wall and may be used to close the open end of the container, and fastener strap 66 may be provided at the free end of flap 65 as in the previous embodiment for wrapping around part of the folded container and holding it in the compact folded condition. As in the previous embodiment, mating strips of hook and loop fastener material are provided on the closure flap, fastener strap, and opposing outer surfaces of the container in the open and storage position. The walls in this embodiment may be of similar four layer construction to that described in the previous embodiments. As in the previous embodiments, foldable horizontal crease lines 68 are provided across the front wall and rear wall. Due to the increased dimensions, additional foldable crease lines 70 extend transverse to crease lines 68 over the front wall, base wall, and rear wall, so that the front and rear wall each have a series of pockets arranged in two horizontal rows, and the base wall has three elongate pockets extending side by side from the front wall to the rear wall. As in the previous embodiment, a gel pack 26 is located in each pocket. In one example, container 55 may have a length of around 21 inches, a width of around 14 inches, and a height of around 14 inches. In FIG. 8, a series of three gel packs is provided in each row in the front and rear walls, but additional gel packs may be provided in larger containers. Containers may be designed with pockets in rows of one to ten in each wall which contains gel packs, and with two or more rows of pockets per wall.

The container 55 can be folded in a similar manner to the previous embodiment, about the horizontal foldable crease lines 68, and then can additionally be folded in a perpendicular direction about crease lines 70. Additional straps or other fasteners (not illustrated) may be provided to hold the container in the folded condition.

Figure 9:
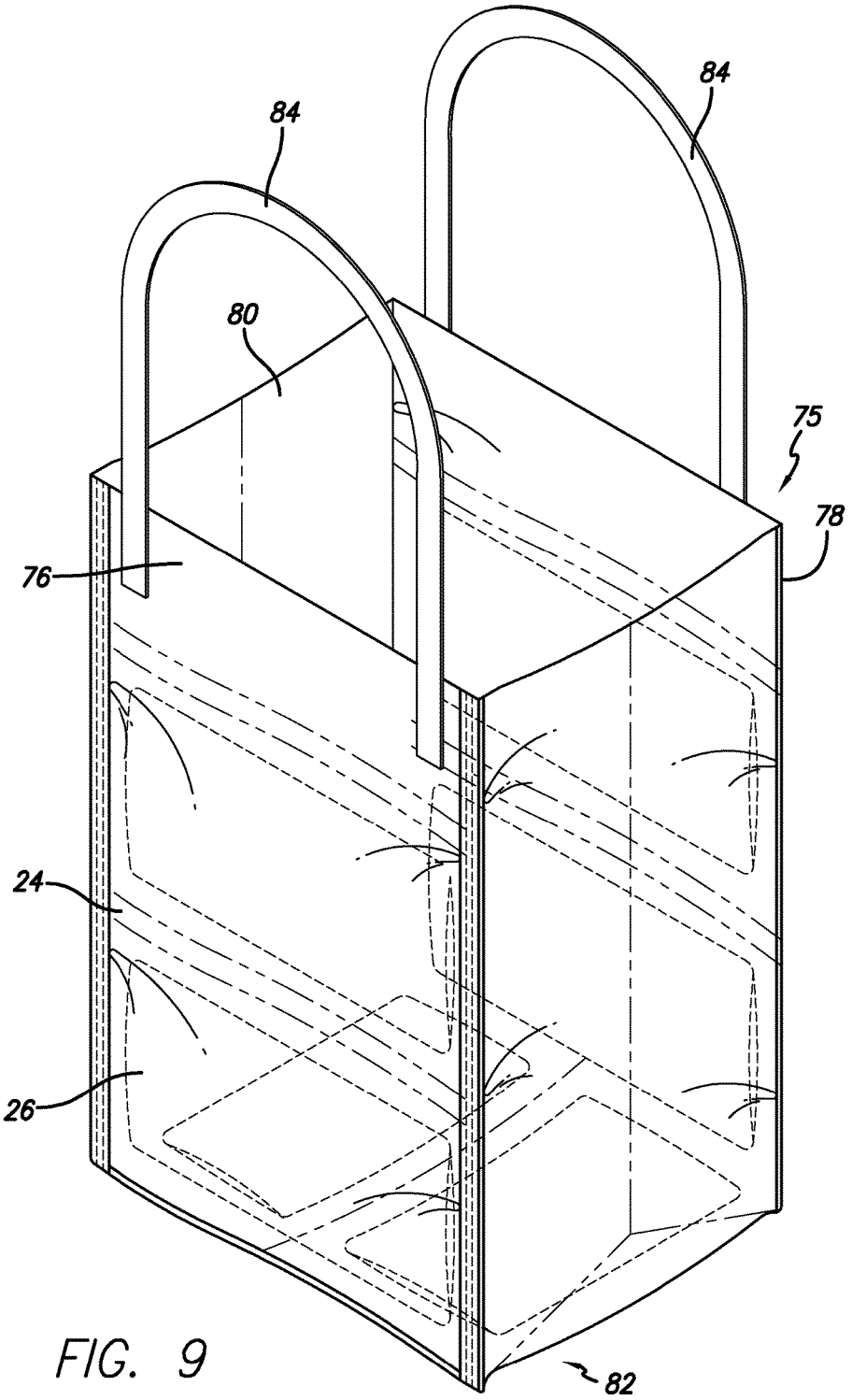
FIG. 9 is a perspective view of a third embodiment of a collapsible insulating container in an open, erect condition.

Another alternative embodiment is illustrated in FIG. 9. The collapsible insulated container 75 of FIG. 9 is configured in the form of a shopping or market tote, allowing a shopper to transport food and the like back from a grocery store while keeping frozen or refrigerated items cool. The container is larger than the lunch sack style of container of FIGS. 1 to 7, and has a front wall 76, rear wall 78, opposite side walls 80, and base wall 82. The construction is similar to the first embodiment, but the upper end is open and handles 84 extend upwardly from the front and rear walls. In this embodiment, gel packs 24 are located in pockets in both the front and rear walls, while two gel packs are located in separate pockets in the base wall extending perpendicular to the pockets in the front and rear wall. Although only two pockets are illustrated in the front wall and rear wall in FIG. 9, two or more rows each having two or more pockets containing a gel pack may be provided in alternative embodiments. The gel pack pockets in the front and rear walls are separated by foldable crease lines 24 of stitching or the like, and the pockets in the base wall are separated by a foldable crease line 85 extending between the front and rear walls. Additional transverse crease lines or lines of stitching may be provided if additional pockets and gel packs are incorporated in the front and rear walls, as in the embodiment of FIG. 8. The tote or bag of FIG. 9 can be folded into a substantially flat configuration for storage, cooling or heating about the foldable crease lines in a similar manner to that described above in connection with the previous embodiments.

Figure 10:
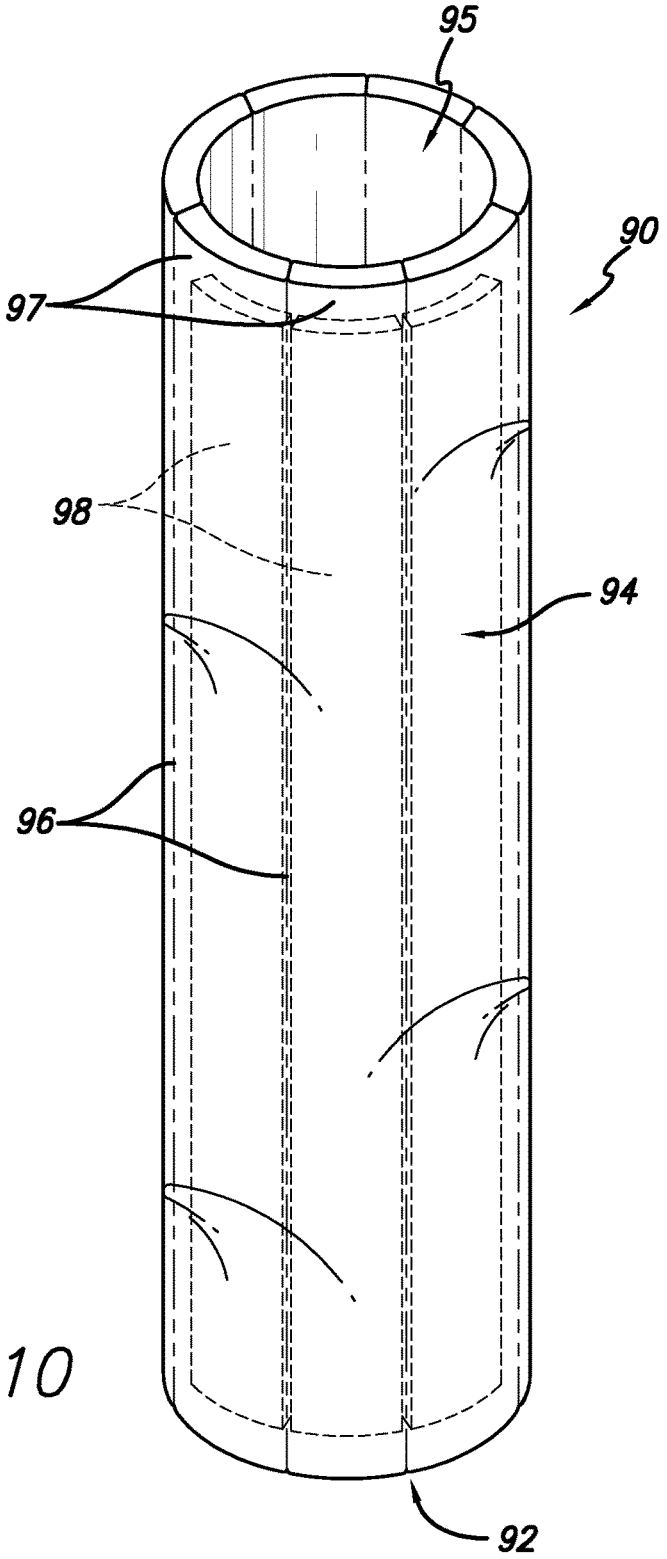
FIG. 10 is a perspective view of a fourth embodiment of a collapsible insulating container of cylindrical shape for holding bottles or other round beverage containers.

The collapsible insulated containers in the previous embodiments are all generally rectangular in shape. FIG. 10 illustrates another embodiment, in which a collapsible insulated container 90 is generally cylindrical in shape, comprising a generally circular base wall 92 and a cylindrical peripheral wall 94 extending from base wall 92 to define an internal cavity 95 with an open end. The peripheral wall has a plurality of spaced, vertically extending foldable crease lines 96, which may comprise one, two or more lines of stitching as described above in connection with the first embodiment. As in the first embodiment, the wall 94 is of multiple layers, and the lines of stitching define successive pockets 97 about the periphery of the container, with a gel pack 98 arranged in each pocket. In one embodiment, base wall may be open. The container illustrated in FIG. 10 may be provided in a range of different lengths and diameters for holding and temperature control of various items of corresponding cylindrical shape, such as wine bottles, baby bottles, soda cans, and the like. As in the previous embodiments, container 90 can be folded into a more compact configuration about foldable crease lines 96. A strap (not illustrated) may be provided to secure the container in a compact folded condition.

The embodiments described above are self-supporting multi-purpose containers that may be used for packing, storing, transporting and insulating food, beverages, medications, or other perishable items that need to be kept cool or warm for extended periods of time. The containers have insulated walls containing gel packs that can maintain the cavity within the container at a substantially constant internal temperature for an extended period of time. The gel material in the gel packs is malleable so that the isolated grid structure of cushioning packs in individual pockets provides extra protection and padding to the items contained, and in one embodiment the gel packs are surrounded by cushioning foam material for additional padding and protection. The arrangement of the foldable crease lines is such that the containers can be folded quickly and easily into a relatively flat configuration when not in use, so that they can be easily placed in a freezer or the like for cooling purposes until the container is needed again.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A collapsible insulated container, comprising:

a base wall; and a peripheral wall extending from the base wall to define a cavity having an open end, such that the open end is opposite the base wall with respect to a first axis of the peripheral wall in an unfolded configuration;

wherein the peripheral wall comprises at least a front wall and a rear wall;

wherein each of the front wall and the rear wall comprises an outer layer, an inner layer between the outer layer and the cavity, at least one crease, at which the inner layer and the outer layer are joined, that extends orthogonal to the first axis of the peripheral wall from one side of the respective wall to an opposite side of the respective wall, a first rectangular gel pack between the inner layer and the outer layer on a side of the at least one crease that is closer to the open end than to the base wall, wherein the first rectangular gel pack longitudinally extends parallel to the at least one crease from one side of the respective wall to an opposite side of the respective wall, and a second rectangular gel pack between the inner layer and the outer layer on an opposite side of the at least one crease that is closer to the base wall than to the open end, wherein the second rectangular gel pack longitudinally extends parallel to the at least one crease from the one side of the respective wall to the opposite side of the respective wall; and wherein the peripheral wall folds along the at least one crease on both the front wall and the rear wall, to place the open end closer to the base wall in a folded configuration than in the unfolded configuration, while the first rectangular gel pack and the second rectangular gel pack remain between the inner layer and the outer layer of the front wall and the rear wall.

2. The container of claim 1, further comprising a fastener strap secured to the container at one end, a first fastener device on the fastener strap and a second, mating fastener device on the outer layer of one of the walls, the fastener strap being configured to extend around at least part of the container in the folded configuration with the first fastener device releasably attached to the second fastener device, whereby the container is held in the folded configuration.

3. The container of claim 2, wherein the base wall and peripheral wall define a storage area, the container further comprising a closure flap extending from the peripheral wall which is movable between an open position and a closed position covering the open end of the container, the fastener strap extending from the closure flap, the closure flap and fastener strap extending about at least part of the periphery of the container in the folded configuration to releasably maintain the container in the folded configuration.

4. The container of claim 3, further comprising side walls that contain no gel packs.

5. The container of claim 1, wherein the container is foldable into the folded configuration by folding the base wall to position at least a portion of the inner layer of the front wall adjacent at least a portion of the inner layer of the rear wall and position at least a portion of the inner layer of the base wall against at least a portion of the inner layer of the front wall and folding at least a portion of the front wall and at least a portion of the rear wall over at least a portion of the base wall.

6. The container of claim 5, further comprising:

a fastener strap secured to the container and having a first fastener device; and a second fastener device secured to the peripheral wall, wherein the fastener strap is configured to extend around at least a portion of the container in the folded configuration to position the first fastener device to releasably attach to the second fastener device, whereby the container is held in the folded configuration by the attachment of the first fastener device to the second fastener device.

7. The container of claim 6, wherein the base wall and peripheral wall define a storage area, the container further comprising a closure flap extending from the peripheral wall which is movable between an open position and a closed position covering the open end of the container, the fastener strap extending from the closure flap, the closure flap and fastener strap extending around at least a portion of the container in the folded configuration to position the first fastener device to releasably attach to the second fastener device, whereby the container is held in the folded configuration by the attachment of the first fastener device to the second fastener device.

8. The container of claim 1, wherein each of the front wall and the rear wall further comprise one or more lines of stitching extending across the respective wall to define at least two pockets between the inner layer and the outer layer of the respective wall, wherein the first rectangular gel pack and the second rectangular gel pack are located in different ones of the at least two pockets.

* * * * *